US008185238B2

(12) United States Patent
González Sainz et al.

(10) Patent No.: US 8,185,238 B2
(45) Date of Patent: May 22, 2012

(54) SYSTEM FOR CARRYING OUT AUTOMATIC DRILLING / RIVETING PROCESS IN AERONAUTICAL ASSEMBLY PIECES

(75) Inventors: Javier González Sainz, Cadiz (ES); Pedro Montero SanJuan, Getafe (ES)

(73) Assignee: Airbus Operations, S.L., Madrid (ES)

( * ) Notice: Subject to any disclaimer, the term of this patent is extended or adjusted under 35 U.S.C. 154(b) by 441 days.

(21) Appl. No.: 12/073,517

(22) Filed: Mar. 6, 2008

(65) Prior Publication Data

US 2008/0300715 A1 Dec. 4, 2008

(30) Foreign Application Priority Data

May 28, 2007 (ES) ..... 200701457

(51) Int. Cl.
*G06F 19/00* (2006.01)

(52) U.S. Cl. ..... 700/245; 700/160

(58) Field of Classification Search ..... 700/245, 700/160, 182, 17, 180
See application file for complete search history.

(56) References Cited

U.S. PATENT DOCUMENTS

| | | | | |
|---|---|---|---|---|
| 4,510,565 | A * | 4/1985 | Dummermuth | 700/7 |
| 5,474,142 | A * | 12/1995 | Bowden | 175/27 |
| 6,092,275 | A * | 7/2000 | Kellner et al. | 29/525.06 |
| 7,047,614 | B2 * | 5/2006 | Scott et al. | 29/407.05 |
| 2005/0150697 | A1 * | 7/2005 | Altman et al. | 178/19.02 |

* cited by examiner

*Primary Examiner* — Kidest Bahta
(74) *Attorney, Agent, or Firm* — Wenderoth, Lind & Ponack, L.L.P.

(57) ABSTRACT

A system of automatic drilling/riveting of pieces for aeronautical assembly, includes a robot governed by a numerical control device containing drilling/riveting information. A module allows for introduction of data by the operator. A piece checking module detects a piece starting from the data input by the operator. A converter module receives from the numerical control device the information input by the operator and information on the detected piece along with the drilling/riveting to be done and converts that information into information that can be read by a governing and graphic representation module, which transforms the information into geometric information to permit graphic representation on a screen.

5 Claims, 2 Drawing Sheets

SYSTEM FOR CARRYING OUT AUTOMATIC DRILLING / RIVETING PROCESS IN AERONAUTICAL ASSEMBLY PIECES

BACKGROUND OF THE INVENTION

1. Field of the Invention

The invention consists of a system for carrying out drilling/riveting in the assembly of aeronautical pieces in automatic facilities, having the aim of permitting the drilling/riveting to be modified in a simple manner, according to the needs required by the pieces for each application.

It is also an object of the invention to enable the machining parameters to be modified.

It is a further object of the invention to permit the configuration of the pieces to be modified so that they can be adapted to the different changes required in each application of the pieces.

2. Description of the Related Art

In the aeronautical sector, there exist automatic facilities intended for carrying out the drilling/riveting tool process of the pieces used in assemblies, for which a robot is used, governed by a numerical control device for carrying out the drilling/riveting in the assembly chain of the different pieces of an aircraft.

Each of these automatic facilities performs a job that is determined by the actual design of the piece. The job to be carried out is defined in the numerical control device, which contains the necessary information for carrying it out and governing the functioning of the robot in such manner that the automatic assembly of the piece is performed. This information is contained in a program saved in the numerical control device and contains thousands of drilling/riveting operations to be performed on the piece in order to effect its automatic assembly.

Due to the characteristics of the aeronautical assembly process, the configuration of the pieces to be drilled/riveted frequently varies from one aircraft to another, as do the production requirements for their assembly and the drilling/riveting parameters. This implies the need to modify the information contained in the numerical control device in order to adapt it to these changes in each aircraft, at all times maintaining the original information as the basis for implementing these modifications in the aircraft that are necessary. In turn, it is occasionally necessary to make changes to the programmed information that has previously been modified.

In this regard, the existence can be stated of two different processes permitting the modification of the information contained in the program of the numerical control device to be modified.

The first of these methods uses the same programming methodology that is followed for obtaining the original program, which is very costly and requires a high degree of specialization. In this case, it is required to load the original program in a CAD/CAM (Computed assisted design/Computer assisted manufacture) programming system and then the modifications required in the program are input, enabling/disabling drillings, changes in the machining parameters, such as the drilling speed, advance speed, etc., and introducing the new needs required in the manufacturing process, in order to then carry out the conversion of the program modified with the CAD/CAM system to the machine language corresponding to the automatic facility, and finally load the program in machine language into the numerical control device.

This process involves a high cost, apart from the considerable difficulty it entails given that it requires the writing of a new program.

The second process that can conventionally be used for effecting these modifications consists of the manual modification of the program by means of using a text editor, which involves a high risk for the pieces to drill/rivet, owing to the high percentage of human error that can exist in this manual execution.

SUMMARY OF THE INVENTION

In order to solve the drawbacks and achieve the objectives stated above, the invention has developed a new system of automatic drilling/riveting of the pieces for aeronautical assembly, which, comprises a robot governed by a numerical control device containing information for carrying out the drilling/riveting of at least one piece, and which presents the novelty that it includes a module for introduction of data by the operator, a piece checking module which detects a piece starting from the data input by the operator, and which is connected to a converter module which receives the information corresponding to the piece input by the operator and accesses the numerical control device, obtaining from it the information on the detected piece along with the drilling/riveting to be done on it, in order to then convert that information into information that can be read by a governing and graphic representation module, in which that information is transformed into geometric information in order to permit the graphic representation of the piece on a screen together with the distribution of the drillings/rivetings to produce, and also the parameters of each rivet.

Moreover, the governing and graphic representation module is connected to an enabling/disabling module for drilling/riveting, and/or to a piece configuration modification module, and/or to a drilling/riveting parameters modification module, in such a way that the governing and graphic representation module is also connected to the data introduction module in order to permit carrying out of the enablement/disablement of the drilling/riveting in each drilling/riveting, and/or of the configuration of the piece, and/or of the drilling/riveting parameters.

Moreover, the governing and graphic representation module is connected to a machine language generation module which, via a transmitter module, is connected to the numerical control device in such a way that the modifications made by the operator are sent from the graphic representation module to the numerical control module in which they are saved.

The piece checking module carries out the detection of that piece on the basis of an identification number for the piece, and/or an identification number of the aircraft and/or a identification number of the manufacturing process, in such a way that the identification of the piece is assured on which the operator wishes to make one, several or all of the changes described above.

In an embodiment of the invention, provision is made for the system to include an automatic generation module for the history of the different changes made in which the different incidents are recorded for producing that history.

This configuration has the great advantage of avoiding the need to modify the program by means of the two methods described in the earlier section, since one entails a high cost and the other a high risk for the aeronautical product.

The inventive system increases the flexibility and speed of response for effecting the modifications made in the actual automatic facility itself, at the same time as drastically reducing the time spent in carrying out that modification and it avoids using complex and costly programming systems. Moreover, by means of the inventive system, it is not necessary for the operator to have a high degree of specialization and the risk caused by human failure in the manual modification of the program is reduced.

The invention permits these changes to be carried out in a way that is very simple.

Included below are a series of figures in which, on an illustrative rather than limiting basis, the inventive object has been represented.

DETAILED DESCRIPTION OF THE INVENTION

Figure 1:
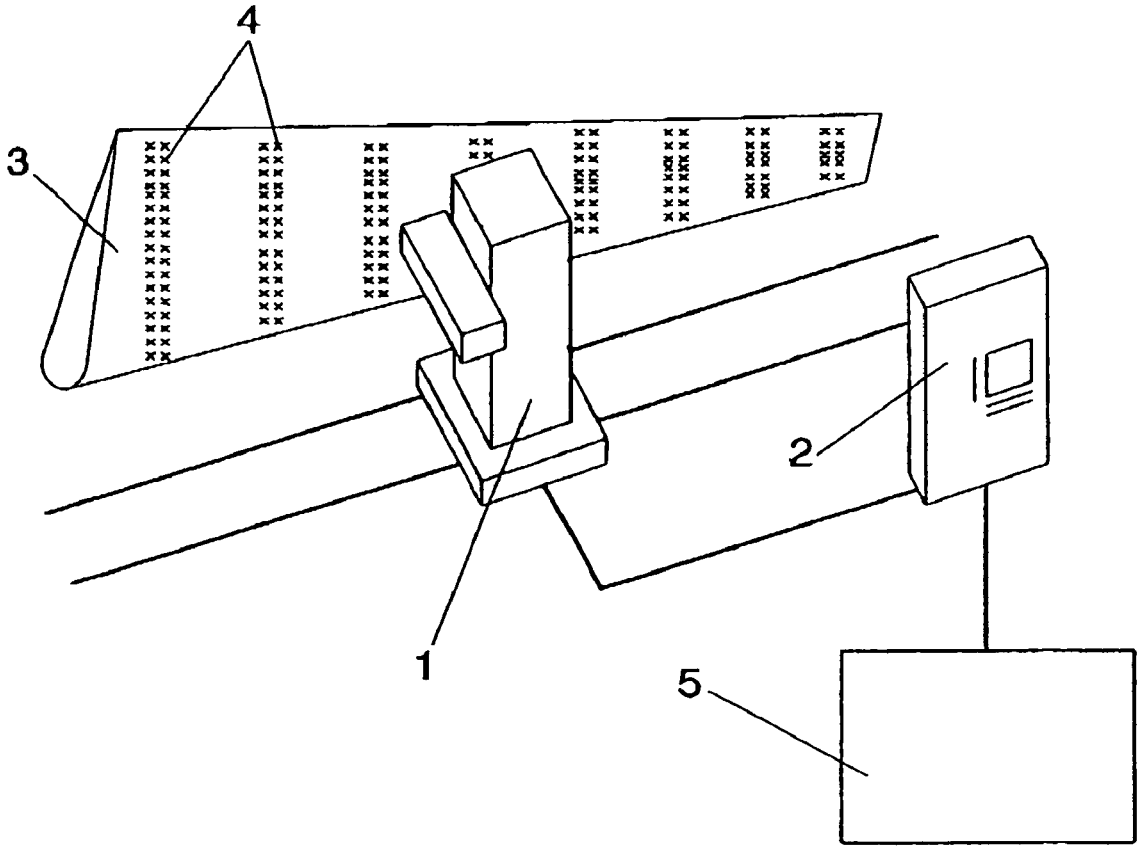
FIG. 1. illustrates a schematic view of a possible example of an embodiment of the invention for carrying out the drilling/riveting of an aeronautical piece.
Figure 2:
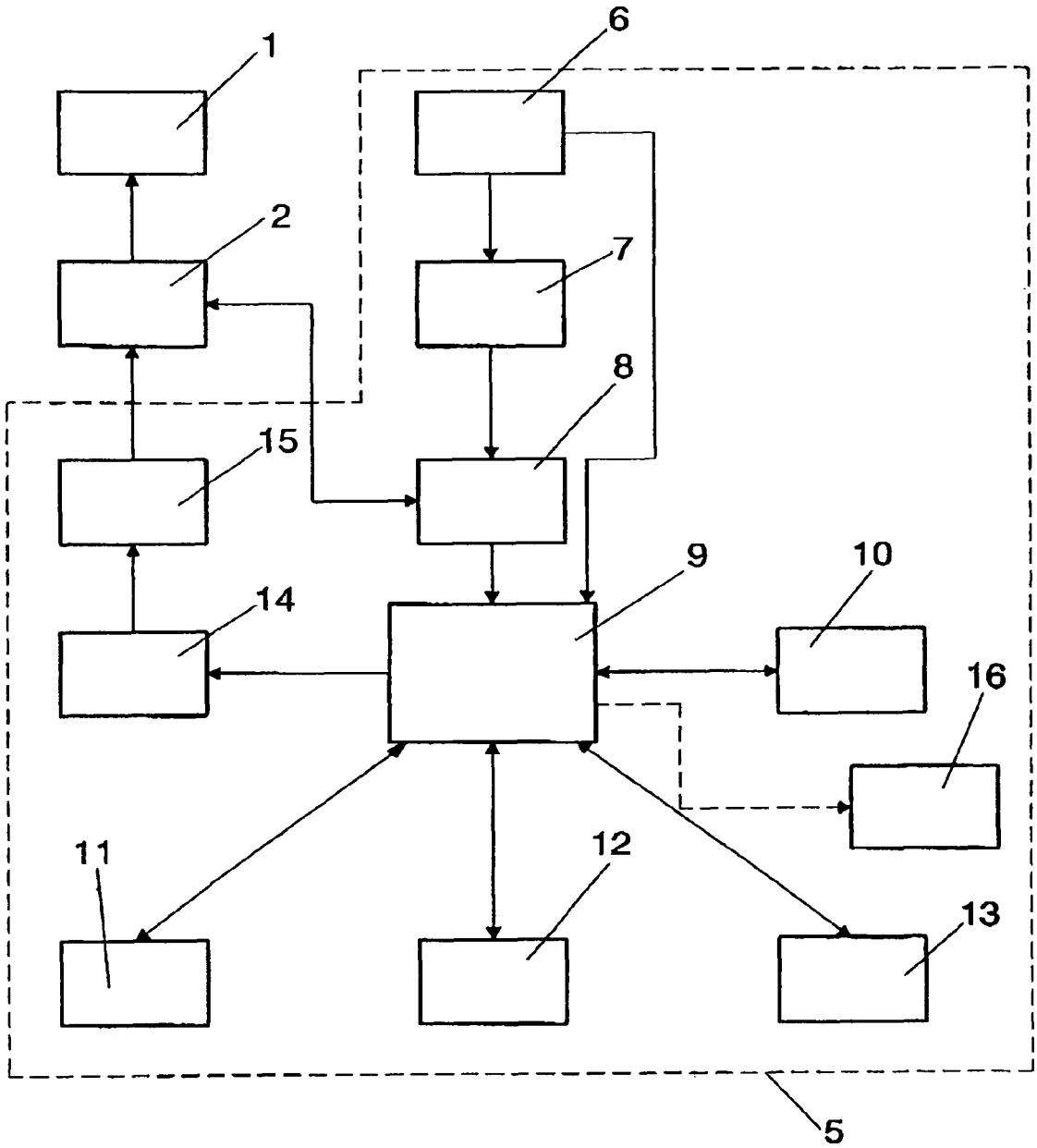
FIG. 2. illustrates a functional block diagram of a possible example of an embodiment of the inventive system, in order to permit changes in drilling/riveting to be effected.

Given below is a description of the invention based on the figures commented upon above.

The inventive system consists of a robot 1 connected to a numerical control device 2 for effecting the drilling/riveting 4 of an aeronautical piece 3, such as for example a wing, a stabilizer or a fuselage, etc., of an aircraft. For this purpose, the numerical control device 2 incorporates information corresponding to the thousands of drilling/riveting operations 4 to perform on the piece 3 that are included in a program which runs in the numerical control device 2, by means of which the functioning of the robot 1 is ordered for carrying out the drillings/rivetings 4.

As has been stated earlier, the characteristics of the assembly process of the same piece frequently vary from one aircraft to another. Because of this, the assembly requirements, and therefore the drillings/rivetings 4, vary according to the needs of each application, which implies the need to be able to modify the information contained in the numerical control device 2, which is done by means of a device 5 which comprises a data introduction module 6 permitting access to the system for an operator in charge of effecting the changes required for each application.

The data introduction module 6 is connected to a piece checking module 7 which, on the basis of the data input by the operator, detects which piece 3 is the one selected by the operator for making changes in the execution of its assembly.

To do this, the operator introduces an identification number of the piece 3, an aircraft identification number and a manufacturing process identification number, in such a manner that the piece checking module 7 verifies each of those numbers and unequivocally identifies the piece on which the operator wishes to effect modifications.

Once the piece checking module 7 has detected which piece is being dealt with, it communicates this to a converter module 8 which consists of a translator provided with means of access to the numerical control device 2 in order to retrieve the information referring to the detected piece 3 and, by means of the translator, it converts that information into information that can be read by a governing and graphic representation module 9, to which it sends the translated information, and in which it is transformed into geometric information, in such a way that the screen 10 displays the graphic representation of the piece 3 with the different drillings/rivetings 4 along with the parameters of each of those drillings/rivetings 4.

In addition, the data introduction module 6 is connected to the governing and graphic representation module 9 in order to permit modifications in the manner that is going to be described further below.

For this, the governing and graphic representation module 9 is also connected to an enabling/disabling module 11 for drilling/riveting 4, to a parameters modification module 12 for drilling/riveting 4, and to a configuration modification module 13 for the piece 3.

Therefore, once the operator knows the changes that have to be made in the assembly of the piece 3, he selects the piece 3 in the manner that was described and, once he displays it on the screen 10 along with the drillings/rivetings 4, he enables/disables them according to the needs required and by means of what is represented on the screen 10, introducing data into the module 6 from which it is sent to the governing and graphic representation module 9, which accesses one of the modules 11, 12 or 13 in order to effect the different changes and displays them on the screen 10.

So, the operator can access the different drillings/rivetings 4 on the screen 10 and enable them or disable them, via the governing and graphic representation module 9, which identifies each of the drillings/rivetings 4 and detects which are marked and enables or disables them according to the indications of the operator, and it communicates this to the enabling/disabling module 11 in which those changes are effected. Via the governing and graphic representation module 9, he then sends those changes to a machine language generation module 14 which, by means of a transmitter module 15, saves them in the numerical control device 2 in such a way that the changes input by the operator via the data introduction module 6 remain recorded in it. So, the numerical control device 2 governs the functioning of the robot 1 according to the enablement/disablement carried out by the operator for each of the drilling/rivetings 4 of the piece 3.

In the same way, the operator can modify the configuration of the piece 3 via the screen 10 for which, once the governing and graphic representation module 9 has identified the new configuration, it sends it to the configuration module 13 for the piece 3, in which the changes are effected and they are saved in the numerical control device 2 in the manner described for the previous case.

Likewise, the operator can modify the machining parameters such as drilling speed, advance, etc., for which each of these parameters has a unique identifier such that the user modifies those parameters via the screen 10 and by means of the governing and graphic representation module 9, so that the latter detects the changes made and accesses the parameters control module 12 and they are saved in the numerical control device 2 in the manner described for the previous cases.

The machine language generation module 14 consists of a translator which carries out the conversion to machine language by means of suitable algorithms.

Finally, it can be pointed out that the invention comprises an automatic history generation module 16 for the different changes made, in which the various changes are recorded so that the history of them can be generated.

The invention provides for the different modules described to be implemented in a personal computer.

The invention claimed is:

1. A system for carrying out an automatic drilling/riveting process for aeronautical assembly pieces, said system comprising:

a robot governed by a numerical control device, the numerical control device comprising data information configured to carry out the drilling/riveting process of at least one piece;

wherein the system is configured so as to enable an operator to change the drilling/riveting process during the drilling/riveting process;

a data input module configured to enable data input by the operator;

a converter module which accesses the numerical control device;

a piece checking module which detects a piece from the at least one piece from the data input by the operator and sends the detected piece to the converter module;

a governing and graphic representation module connected to the data input module and to a machine language generation module;

a transmitter module connected to the numerical control device and to the machine language generation module;

wherein the converter module is configured to retrieve from the numerical control device the data information of the detected piece for the drilling/riveting process to be carried out on the detected piece, the information being sent to the governing and graphic representation module with a previous conversion of the information into a legibility format by the governing and graphic representation module;

the governing and graphic representation module is configured to transform the information received into geometric information for the graphic representation of the detected piece on a screen together with the distribution of the drilling/riveting process to be carried out on the detected piece and also the parameters of each drilling/riveting; and the numerical control device is configured to save modifications from the governing and graphic representation module via the transmitter module, the modifications being made by an operator according to the information displayed on the screen.

2. The system of claim 1, wherein the governing and graphic representation module is connected to a module selected from among an enabling/disabling module configured so as to enable drilling/riveting, a piece configuration modification module, a parameters modification module configured so as to enable drilling/riveting and a combination thereof, configured to carry out the modifications.

3. The system of claim 2, wherein the piece checking module detects the piece on the basis of a number selected from among a piece identification number, an aircraft identification number, a manufacturing process identification number and a combination of them.

4. The system of claim 2, further comprising an automatic history generation module configured to generate a history of different changes made.

5. The system of claim 3, further comprising an automatic history generation module configured to generate a history of different changes made.

* * * * *